United States Patent [19]

Waddington et al.

[11] Patent Number: 4,813,748

[45] Date of Patent: Mar. 21, 1989

[54] MINING MACHINERY HAULAGE SYSTEM

[75] Inventors: Brian Waddington, Gainsborough; Clive O. Hibbert, Southcave, both of England

[73] Assignee: Mining Supplies (Longwall) Limited, Balby, England

[21] Appl. No.: 128,428

[22] Filed: Dec. 3, 1987

[30] Foreign Application Priority Data

Dec. 5, 1986 [GB] United Kingdom ..... 8629096

[51] Int. Cl.[4] ..... E21C 29/00

[52] U.S. Cl. ..... 299/43; 105/29.1

[58] Field of Search ..... 299/42, 43, 34, 18; 105/29.1; 305/50; 474/210, 212, 218, 219, 220

[56] References Cited

U.S. PATENT DOCUMENTS 449,166 3/1891 McCray ..... 305/50 X
4,536,036 8/1985 Hogg ..... 299/43

FOREIGN PATENT DOCUMENTS 2523639 9/1983 France .
1265171 3/1972 United Kingdom .
1352543 5/1974 United Kingdom .
1367055 9/1974 United Kingdom .
1490865 9/1975 United Kingdom .
1490864 11/1975 United Kingdom .
1525648 7/1977 United Kingdom .
1562527 7/1977 United Kingdom .
1500904 2/1978 United Kingdom .
1507903 4/1978 United Kingdom .
1528398 10/1978 United Kingdom .
1534029 11/1978 United Kingdom .
2015450 9/1979 United Kingdom .
2054701 2/1981 United Kingdom .
2058882 4/1981 United Kingdom .
2094866 9/1982 United Kingdom .
2125858 3/1984 United Kingdom .
2176522 12/1986 United Kingdom .

*Primary Examiner*—Jerome W. Massie, IV
*Assistant Examiner*—David J. Bagnell

[57] ABSTRACT

A rack (2) for use with a mining machinery haulage system (1), comprising a plurality of individual segments (16) so located with respect to one another as to define the length of the rack (2), and each segment being provided with at least one formation (17) and each connected to an adjacent segment (16) by a connector (18) articulated to both segments (16) to which it is common, and with the pitch of the segments (16) and hence the pitch of their formations (17), controlled either by adjacent segment-to-segment abutment, or by segment-to-connector-to-segment abutment. The invention also includes a mining machinery haulage system (1) provided with racks (2).

9 Claims, 5 Drawing Sheets

MINING MACHINERY HAULAGE SYSTEM

This invention relates to a mining machinery haulage system, and to a rack for such a system, for the hauling of longwall mineral mining machines to and fro along a mineral e.g., coal face, the machine being mounted on, and/or guided by an armoured scraper chain conveyor which extends along the mineral face and is constructed from a plurality of unit-length line pans secured together end-to-end in articulated manner.

In recent years the tensioned and static haulage chain, which extended along the face, was staked at each end and was engaged by a drive sprocket of an on-board machine haulage unit, has been replaced by so-called "chainless" haulage systems providing substantial advantages, which need not be recited here, in which systems the haulage chain is replaced by a rack engaged either by a drive sprocket(s) of the machine haulage unit(s) or by a relatively short length, endless chain of the machine haulage unit(s). Some "chainless" haulage systems such as those described in GB 1265171, 1352543, 1562527, 1500904, 1490864, 1490865 and 1507903 have employed a rack in the form of rigid rack bars, usually approximating in length to the length of an industry-standard line pan, i.e., 5 ft (1.5 m), and such rigidity has not infrequently led to engagement difficulties between the drive sprocket(s) or chain and the rack bar(s), due to the relative movement that occurs in service between adjacent line pans, e.g., following humps or swillies in a mine floor, or when advancing by the conventional "snaking" technique to a newly exposed mineral face. Furthermore, rack bar systems require precise, fixed pitch rack bars, having no provision for eliminating or obviating any pitch error. Additionally, haulage forces of several tons are transmitted via the rack bars to the individual line pans.

Other proposals described for instance in GB 903698 and 2058882, have been to provide a rack in the form of a constrained static chain, which has flexibility advantages over a rigid rack bars.

According to a first aspect of the present invention, there is provided a rack for use with a mining machinery haulage system, comprising a plurality of individual segments so located with respect to one another as to define the length of the rack, and each segment being provided with at least one formation and each connected to an adjacent segment by a connector articulated to both segments to which it is common, and with the pitch of the segments, and hence the pitch of their formations, controlled by adjacent segment-to-segment abutment.

According to a second aspect of the present invention, there is provided a rack for use with a mining machinery haulage system comprising a plurality of individual segments so located with respect to one another as to define the length of the rack, each segment being provided with at least one formation and each connected to an adjacent segment by a connector articulated to both segments to which it is common, and with the pitch of the segments, and hence the pitch of their formations, controlled by adjacent segment-to-connector-to-segment abutment.

The invention thus provides a flexible rack of alternating segments and connectors in which any form of formation, e.g., a projecting male tooth or a female pocket, can be accommodated for compatability with various drives of various machine manufacturers; there is the ability to negotiate varying gaps between adjacent ends of adjacent line pans; to accommodate the so-called snaking conveyor advance as well as mine floor and hence line pan undulations; pitch error is eliminated as the segments are free to move, within limits, when acted upon by a machine haulage drive; the rack is under compressive load only (certainly for single machine operation) when acted upon by machine haulage drive; the haulage reaction force is transmitted to an end of conveyor rather than to each pan; the system can be used vertically or horizontally; and the system can be used with more than one haulage sprocket or chain. In practice, the connectors control at least the maximum pitch of the teeth, while the minimum pitch may be controlled either by the connectors or by the segments.

Conveniently, each connector is constituted by a link, of circular section material, being either a generally standard oval link of a round link chain, or alternatively a ring. In either case the articulation is by a hinging movement between a segment and its connector(s) in a vertical plane, about a horizontal axis, assuming the conveyor is located horizontally. A connector in the form of a link of circular section material may be secured to a segment by providing the latter with two transversely extending through holes, or slots, one located at each end of the segment, with each through hole or slot having a minimum diameter slightly exceeding the diameter of the portion of the link to be received in the through hole or slot. Alternatively, the connector may be provided with a single slot so dimensioned as to accommodate two connectors, e.g., links, one at each opposite end of the slot. The latter preferably has a transversely extending, arcuate bearing face of curvature corresponding to the inside profile of the link, which profile is to engage such bearing face for the transmission of tensile loads. It is also preferred for each segment to have a base portion projecting below the connectors.

It will be appreciated that, depending on the location of the drive means (such as a haulage sprocket or haulage chain) of the machine haulage unit along the overall length of the rack, part of the rack will be in compression and, dependent upon various operating conditions, part of the rack could be in compression. When tensile loading the rack is involved, the individual connectors transmit these loads via their associated tooth segments. When compressive loading of the rack is involved, these loads are transmitted in a first embodiment by segment-to-segment abutment, or in a second embodiment by segment-to-connector-to-segment abutment, as described below.

In the first embodiment, it can be arranged by differently dimensioning the various components, e.g., by making the through holes slotted, that the chain links transmit only tensile loads, because the play resulting from the slotted holes results, when compressive loads are being transmitted, in abutment between adjacent ends of adjacent segments. With this first embodiment the adjacent ends are preferably curved to enable them to provide the necessary clearance to permit articulation with respect to one another to accommodate undulations of the associated conveyor.

Alternatively, in the second embodiment, it is can be arranged, by suitably dimensioning the segments, the through holes, the play and the connectors, for compressive loads also to be transmitted by the connectors, whereby adjacent ends of adjacent segments do not abut one another under compressive loading, with permanent clearance, e.g., a vertical gap, between adjacent ends of adjacent segments, the clearance being of variable dimensions, dependent upon whether tensile or compressive loads are being transmitted.

Preferably, each segment is provided with a single formation, while the rack is built-up, from alternating segments and connectors, to a suitable length, i.e., that of the associated conveyor, e.g. 200 yds. Obviously, the terminal segment at each end of the rack is only connected to one connector, while the rack is restrained, or staked, by suitable means at each end of the mineral face or the armoured face conveyor.

Conveniently, a conveyor furnishing for carrying the rack in accordance with the first aspect of the invention, and for attachment to an adjacent, e.g., goaf side, sidewall of a line pan of an armoured, scraper chain conveyor, comprises (for a horizontally disposed conveyor) an upright spill plate with a horizontal shelf plate carried by the spill plate and extending towards the conveyor, the shelf being provided with a trapping groove for one side portion of the connector remote from the spill plate, with a removable trapping rail being securable, e.g., by bolts to the shelf, to trap the other side portion of the link adjacent the spill plate, with the segments being capable of sliding movement along the shelf plate. Preferably, the shelf and trapping groove are formed as parts of an elongate, cast trapping rail, which corresponds in length to the line pan to which the rail is, in use, attached, the rail also preferably incorporating a trapping rib to trap the slide shoes of the associated mineral winning machine.

The system in accordance with the second aspect of the invention may employ an onboard, endless haulage chain of the general type disclosed in GB 1265171, i.e., carrying male projections to engage the formations, e.g., teeth, of the rack, whereby the haulage drive is adjustable to accommodate different combinations of machine, machine underframe and conveyors. Alternatively of the general type disclosed in GB 1352543, i.e., wherein pockets in the chain engage the teeth of the rack.

The invention will now be described in greater detail, by way of examples, with reference to the accompanying drawings.

Figure 2:
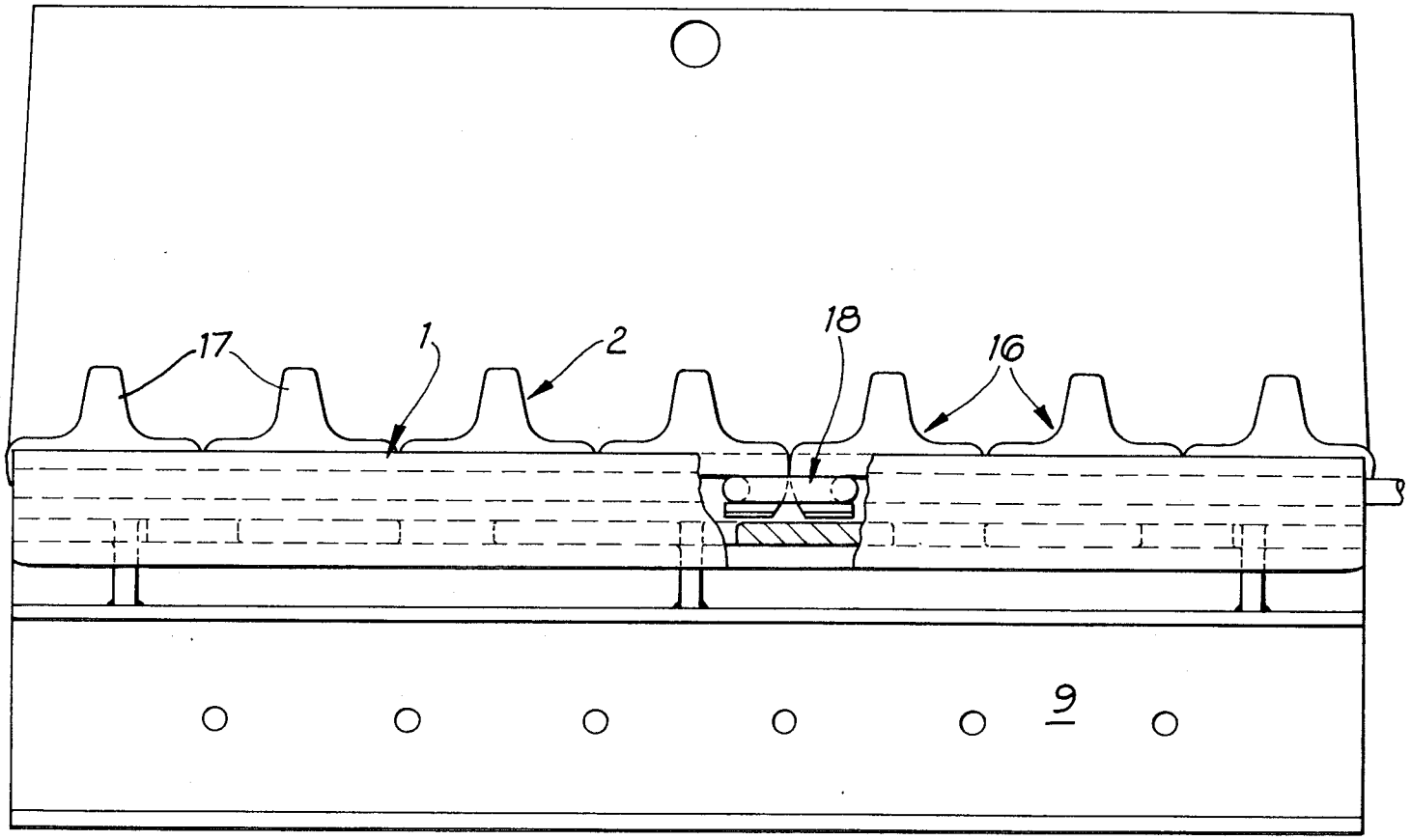
FIG. 2 is an enlarged view of one embodiment of haulage system and rack in accordance with the invention.
Figure 8:
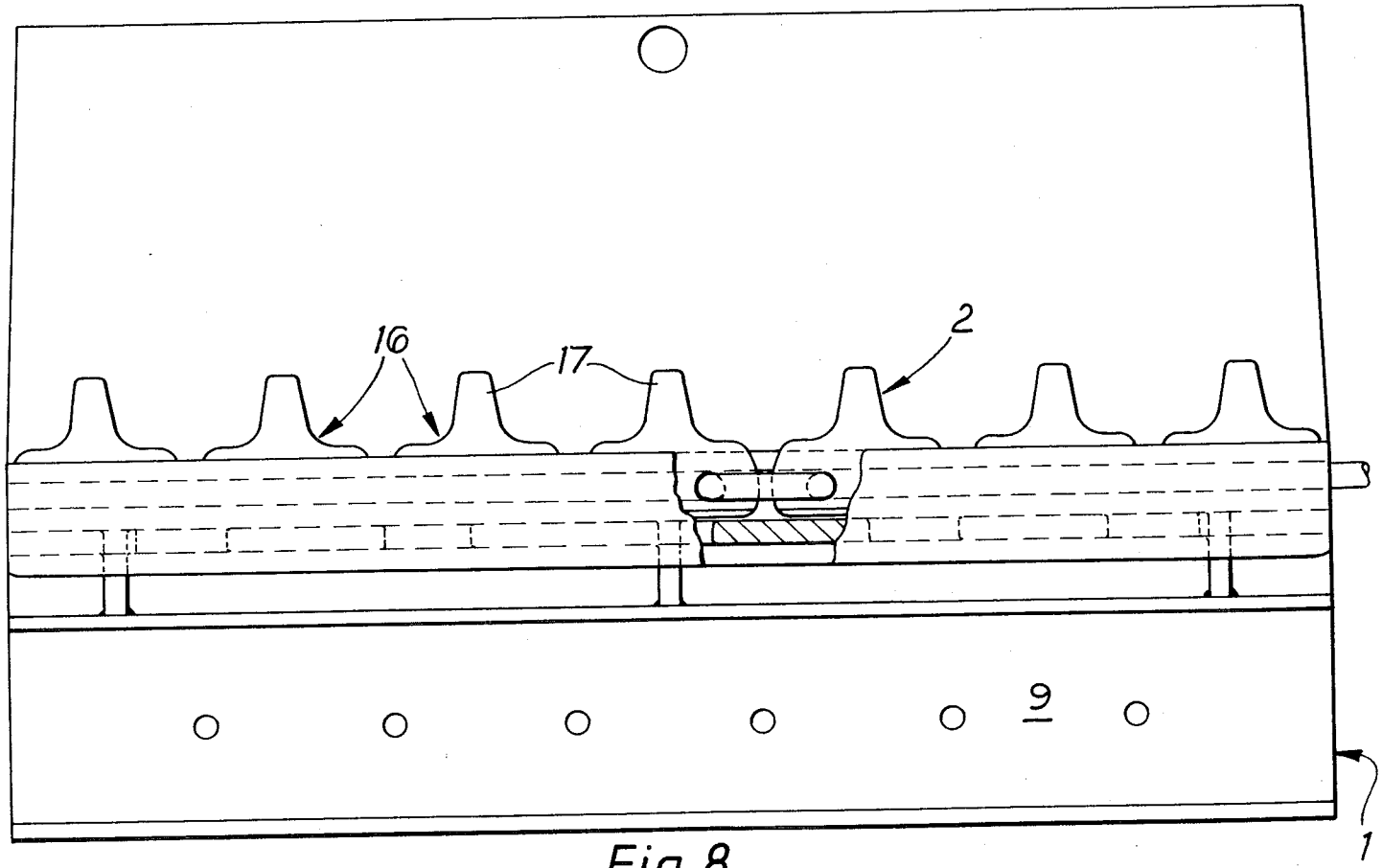

FIG. 8 corresponds to FIG. 2 but shows another embodiment.

In both embodiments, like reference numerals are used for like components.

Figure 1:
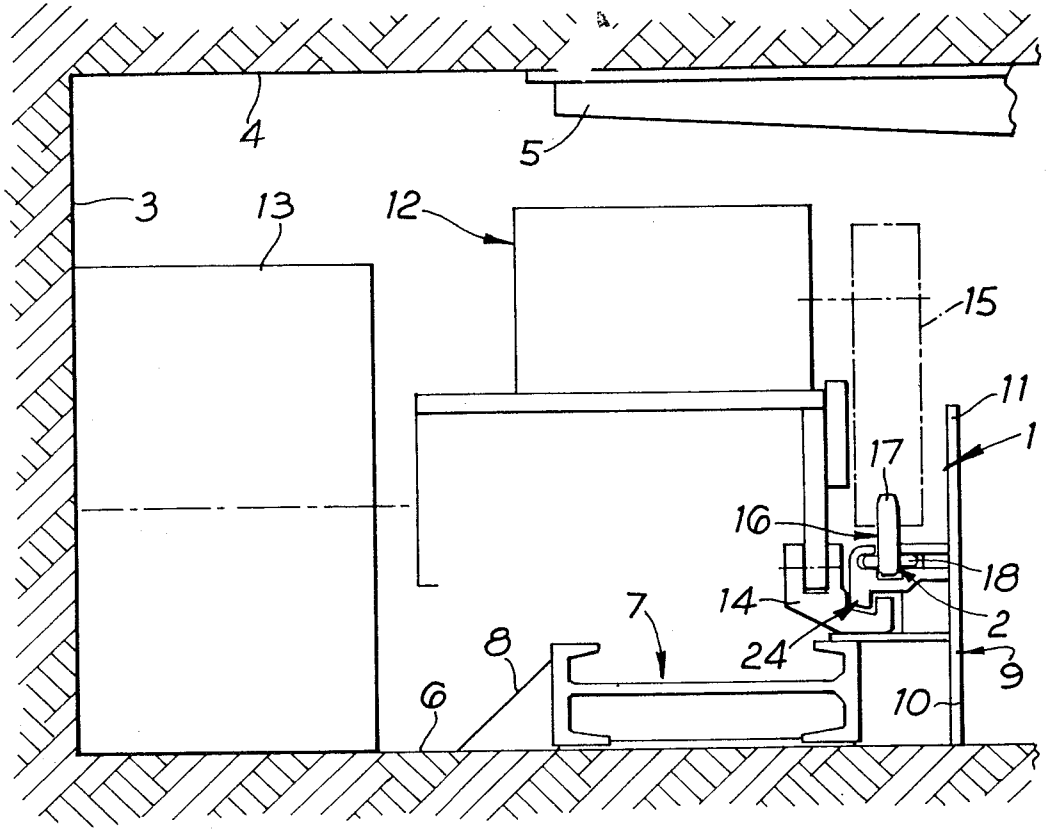
FIG. 1 is a diagrammatic side elevation of a mining machinery haulage system and rack in accordance with the invention.

In FIG. 1, a mining machinery haulage system in accordance with the second aspect of the invention is indicated at 1 and a rack in accordance with the first aspect of the invention is indicated at 2.

The equipment 1 and 2 is illustrated located along a longwall mineral face 3, with a mine roof indicated at 4 supported by a roof support 5 and with the mine floor indicated at 6. An armoured, scraper chain conveyor 7 builtup to required length from a plurality of unit length line pans in the conventional manner, is seated on the mine floor 6 and extends the length of the face 3, the conveyor 7 being provided at its face side with a ramp plate 8 and at its goaf side with fabricated conveyor furnishings 9 comprising a horizontal shelf plates 10 and an upright spill plate 11. A mineral winning machine 12 is provided with a mineral winning drum 13. The machine 12 is mounted on, and guided by, the conveyor 7 by slide shoes, in the conventional manner, only the goaf side slide shoes 14 being indicated, while the machine is adapted to haul itself to and fro along the conveyor 7 by means of an on-board haulage unit comprising an endless haulage chain 15 of the general type disclosed in GB 1352543, i.e. incorporating female pockets to engage male formations (to be described in detail later) on the rack 2, as the chain 15 is adapted to crawl along the rack 2, as the machine progresses along the conveyor 7 and hence along the mineral face 3.

Figure 3:
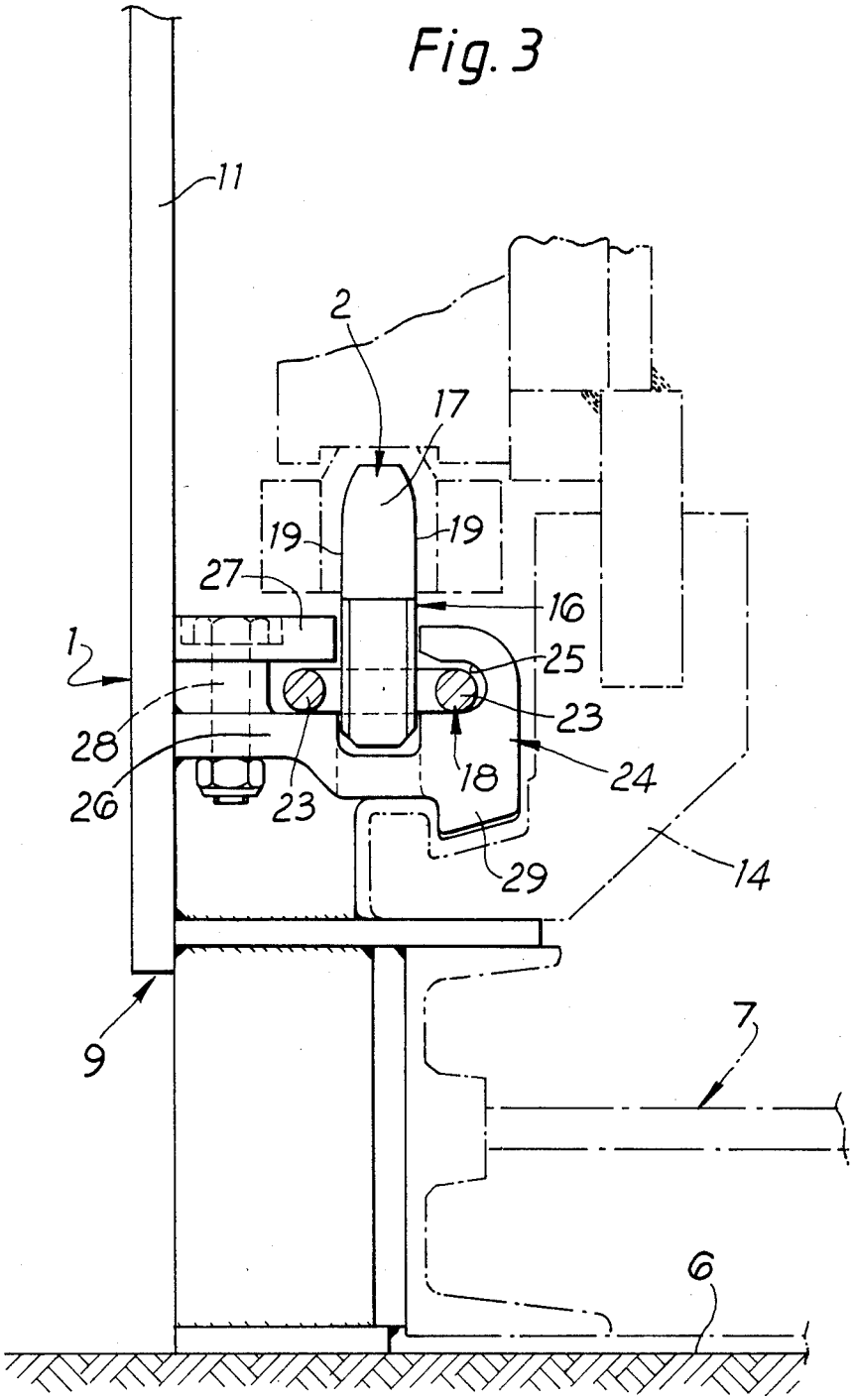
FIG. 3 is a side elevation of FIG. 2.
Figure 4:
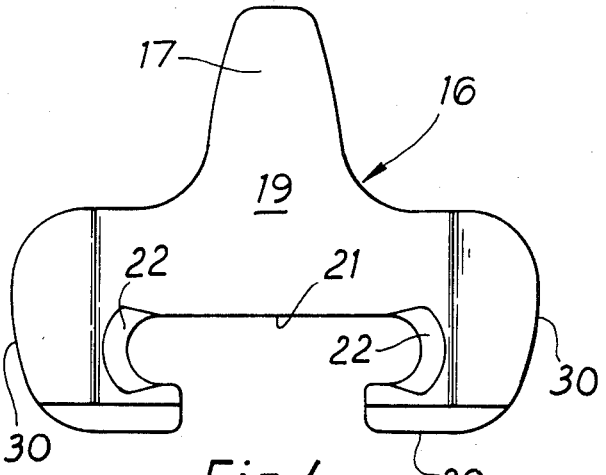
FIGS. 4, 5 and 6 are respectively a side elevation, end elevation and plan of the tooth segment of FIGS. 1 to 3.
Figure 5:
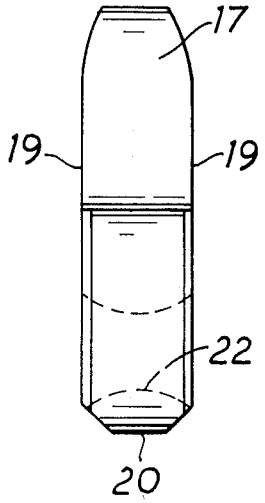

In FIGS. 2, 3 and 8, each rack 2 comprises a plurality of segments 16 of a kind incorporating a formation in the form of a single projecting male tooth 17. In fact seven segments 16 are provided for a 5 ft. (1.5 m) length rack 2. Each tooth segment 16 is connected to an adjacent tooth segment by a connector 18 in the form of a circular section chain link illustrated in FIGS. 1 to 3, 7 and 8, the connector 18 being articulated, with play, to both adjacent tooth segments 16 to which it is common. Clearly, the terminal tooth segments 16 at each end of the rack 2 are only connected to one connector 18.

Figure 6:
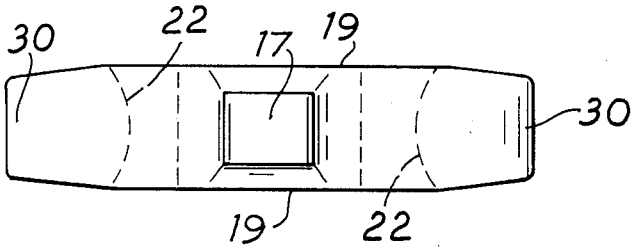
Figure 7:
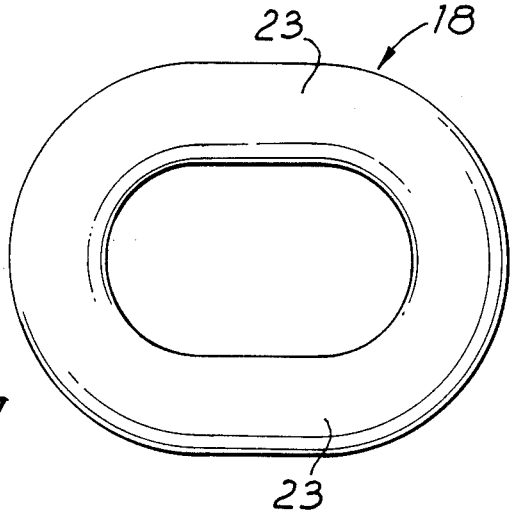
FIG. 7 is a plan view of the connector of FIGS. 1 to 3 and 8.

In detail, each tooth segment 16 has a side portion 19 and a base portion 20. As best seen in FIGS. 6 to 8, each tooth segment 16 is provided with a slot 21 having at each end a transversely extending arcuate bearing surface 22 of curvature corresponding to the inside profile of the link connector 18.

Furthermore, each connector 18 has side portions 23 projecting laterally beyond the side portions 19 of the tooth segments 16, as illustrated in FIGS. 1, 3 and the side portions 23 are trapped to the furnishing 9, and in particular to a trapping rail 24, preferably produced as a casting, and comprising a trapping groove 25 to receive one side portion 23, with the other side portion 23 seated on a shelf plate 26 of the trapping rail 24 with a removable trapping strip 27 secured by bolts 28 to complete the trapping of the other side portion 23. The trapping rail 24 incorporates a downwardly projecting rib 29 serving, in turn, to trap the slide shoes 14.

It will be appreciated that when it is required to displace the machine along the conveyor 7 the haulage unit is activated, which in turn sets in motion the haulage chain 15, with pockets in the chain 15 progressively engaging the teeth 17 of the rack 2, the chain 15 reacting on the haulage system 1 and rack 2 in accordance with the first and second aspects of the invention, with the reaction forces being transmitted to the ends of conveyor 7. It will also be appreciated that, depending on the location of the machine on the conveyor 7, and indeed whether single or multiple machines are operating on a single conveyor 7, that the pitch of the segments 16, and in particular their teeth 17, is controlled by segment-to-segment abutment, and hence part of the rack 2 will be in compression, with compressive loads on the rack 2 transmitted by one tooth segment 16 abutting an adjacent tooth segment 16, and, for purposes of articulation, terminal ends 30 of each segment 16 are curved.

In the embodiment of FIG. 8, compressive loads on the rack 2 are transmitted by segment-to-connector-to-segment abutment, i.e. one tooth segment 16 abuts its associated link connector 18, which in turn abuts the next adjacent tooth segment 16. In both embodiments, tensile loads are transmitted via the link connectors 18.

What I claim is:

1. A mining machinery haulage system, comprising an armoured, scraper chain conveyor extending along a mineral face to be mined, a longwall mining machine guided by said conveyor for to and fro movement with respect to said conveyor and said mineral face, a haulage unit provided on said mining machine to propel said machine along said conveyor, a furnishing attached to said conveyor, and a rack extending along said conveyor, said rack comprising a plurality of individual segments so located with respect to one another as to define the length of said rack, with at least one male tooth provided on each said segments to present a row of upwardly projecting, male teeth extending along the conveyor, a connector forming an articulated connection between two adjacent segments, and with the pitch of said segments, and hence the pitch of their said male teeth, being controlled by adjacent segment-to-segment abutment, with compressive loading between adjacent segments when said haulage unit is activated to effect progressive engagement of said teeth of said row by said haulage unit as said machine crawls along said conveyor, with side portions provided on both said segments and said connectors, said connector side portions projecting laterally beyond corresponding segment side portions and engaged by trapping means, by which said rack is trapped to said furnishing.

2. A system as claimed in claim 1, wherein each of said connectors is constituted by a link, of circular section material.

3. A system as claimed in claim 1, wherein a single slot is provided in each of said segments, said slot being adapted to receive two of said connectors, one at each opposite end of said slot.

4. A system as claimed in claim 3, wherein a transversely extending, curved bearing surface of curvature corresponding to the inside profile of said connector constituted by a link of circular section material, is provided on the connector receiving portion of said slot.

5. A mining machinery haulage system, comprising an armoured, scraper chain conveyor extending along a mineral face to be mined, a longwall mining machine guided by said conveyor for to and fro movement with respect to said conveyor and said mineral face, a haulage unit provided on said mining machine to propel said machine along said conveyor, a furnishing attached to said conveyor, and a rack extending along said conveyor, said rack comprising a plurality of individual segments so located with respect to one another as to define the length of said rack, with at least one male tooth provided on each of said segments to present a row of upwardly projecting, male teeth extending along the conveyor, a connector forming an articulated connection between two adjacent segments, and with the pitch of said segments, and hence the pitch of their said male teeth, being controlled by adjacent segment-to-connector-to-segment abutment, with compressive loading between adjacent segments when said haulage unit is activated to effect progressive engagement of said teeth of said row by said haulage unit as said machine crawls along said conveyor, with side portions provided on both said segments and said connectors, said connector side portions projecting laterally beyond corresponding segment side portions and engaged by trapping means, by which said rack is trapped to said furnishing.

6. A system as claimed in claim 5, wherein two transversely extending through holes are provided in each of said segments, said through holes being of dimension to receive an associated connector, with articulation and play.

7. A system as claimed in claim 6, wherein each through hole is circular.

8. A system as claimed in claim 6, wherein each through hole is slotted.

9. A system as claimed in claim 6, wherein a transversely extending, curved bearing surface of curvature corresponding to the inside profile of said connector constituted by a link of circular section material, is provided on the connector receiving portion of said hole.

* * * * *